US005192193A

United States Patent [19]

Cooper et al.

[11] Patent Number: 5,192,193

[45] Date of Patent: Mar. 9, 1993

[54] IMPELLER FOR CENTRIFUGAL PUMPS

[75] Inventors: Paul Cooper, Titusville, N.J.; Donald P. Sloteman, New Hope, Pa.

[73] Assignee: Ingersoll-Dresser Pump Company, Liberty Corner, N.J.

[21] Appl. No.: 719,025

[22] Filed: Jun. 21, 1991

[51] Int. Cl.[5] ..... F04D 29/22; F04D 29/66

[52] U.S. Cl. ..... 416/186 R; 416/223 B

[58] Field of Search ..... 416/179, 182, 183, 185, 416/186 R, 223 B, 243

[56] References Cited

U.S. PATENT DOCUMENTS

| | | | |
|---|---|---|---|
| 1,169,476 | 1/1916 | Gramlich | 416/186 R |
| 1,946,273 | 2/1934 | Carr | 416/186 R |
| 2,830,753 | 4/1958 | Stalker . | |
| 2,839,239 | 6/1958 | Stalker . | |
| 2,922,374 | 1/1960 | Perish | 416/186 R |
| 3,013,501 | 12/1961 | Ygge | 416/179 |
| 3,285,187 | 11/1966 | Anderson | 416/183 |
| 3,737,249 | 6/1973 | Cooper . | |
| 3,759,628 | 9/1973 | Kempf | 416/185 |
| 3,953,150 | 4/1976 | Onal . | |
| 3,972,646 | 8/1976 | Brown et al. . | |
| 3,989,406 | 11/1976 | Bliss . | |
| 4,012,172 | 3/1977 | Schwaar et al. . | |
| 4,080,102 | 3/1978 | Schwab . | |
| 4,135,858 | 1/1979 | Entat . | |
| 4,208,169 | 6/1980 | Becker et al. | 416/185 |
| 4,358,246 | 11/1982 | Hanson et al. . | |
| 4,626,174 | 12/1986 | Sato et al. . | |
| 4,752,187 | 6/1988 | Hergt et al. . | |
| 4,795,312 | 1/1989 | Purcaru . | |

FOREIGN PATENT DOCUMENTS

| | | | |
|---|---|---|---|
| 85418 | 7/1894 | Fed. Rep. of Germany | 416/243 |
| 781396 | 11/1980 | U.S.S.R. | 416/186 R |
| 336977 | 4/1929 | United Kingdom | 416/186 R |
| 636290 | 4/1950 | United Kingdom . | |
| 707810 | 4/1954 | United Kingdom | 416/186 R |
| 1142732 | 2/1969 | United Kingdom . | |
| 8000468 | 3/1980 | World Int. Prop. O. | 416/183 |

OTHER PUBLICATIONS

Palgrave and Cooper, Proceedings of the 3rd International Pump Symposium, Texas A & M University, May 1986, pp. 61–68.

*Primary Examiner*—Edward K. Look
*Assistant Examiner*—James A. Larson
*Attorney, Agent, or Firm*—Michael H. Minns

[57] ABSTRACT

A cavitation resistant impeller for liquid-conveying centrifugal pumps has a plurality of impeller vanes, each vane having, in combination, a leading inlet edge with a root portion extending upstream of its tip portion; a vane thickness that is greater upstream of the impeller throat than the vane thickness downstream of the impeller throat; and an elliptical nose on the leading inlet edge. The invention can be used in straight-vaned impellers or in Francis-type impellers.

5 Claims, 3 Drawing Sheets

IMPELLER FOR CENTRIFUGAL PUMPS

BACKGROUND OF THE INVENTION

This invention relates to impellers for centrifugal pumps of the type used to convey liquids. More particularly, it relates to straight-vaned impellers, commonly called radial impellers, and also to Francis-type impellers, commonly called semi-axial impellers.

In high energy pump impellers, cavitation can develop along impeller blades and adjacent surfaces in the following locations:

a. along the impeller blade surface;

b. near the intersection of the impeller blade with the hub surface; and c. at the nose of the leading edge of the impeller blade. Such cavitation can cause rapid erosion of impeller blades at these locations, leading to early failure of the impeller or increased need for repairs.

An approach to combat this cavitation problem consists of modifying the curvature of each impeller vane on the suction side, in the area of the leading edge of the vane. However, this teaching deals with cavitation along the sides surfaces of impeller vanes, but does not address the cavitation at the other above-specified locations. There is a need, therefore, for an improved impeller that inhibits cavitation along the impeller blade surface, near the intersection of the impeller blade with the hub surface and at the nose of the leading edge of the impeller blade.

The foregoing illustrates limitations known to exist in present impellers. Thus it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of this invention, this is accomplished by providing an impeller having a front shroud; a rear hub; a plurality of vanes spanning the distance therebetween; an inlet throat opening; and each vane having a span between the shroud and the hub, a leading inlet edge having a root portion upstream of its tip portion; a concave surface on the inlet leading edge beginning at a point between the tip and the mid-point of the span and extending to the root portion; and a vane thickness upstream of the throat that is thicker than a vane thickness downstream of the throat.

The foregoing and other aspects will become apparent from the following detailed description when considered in conjunction with the accompanying drawing figures.

BRIEF DESCRIPTION OF THE DRAWING FIGURES

DETAILED DESCRIPTION

Figure 1:
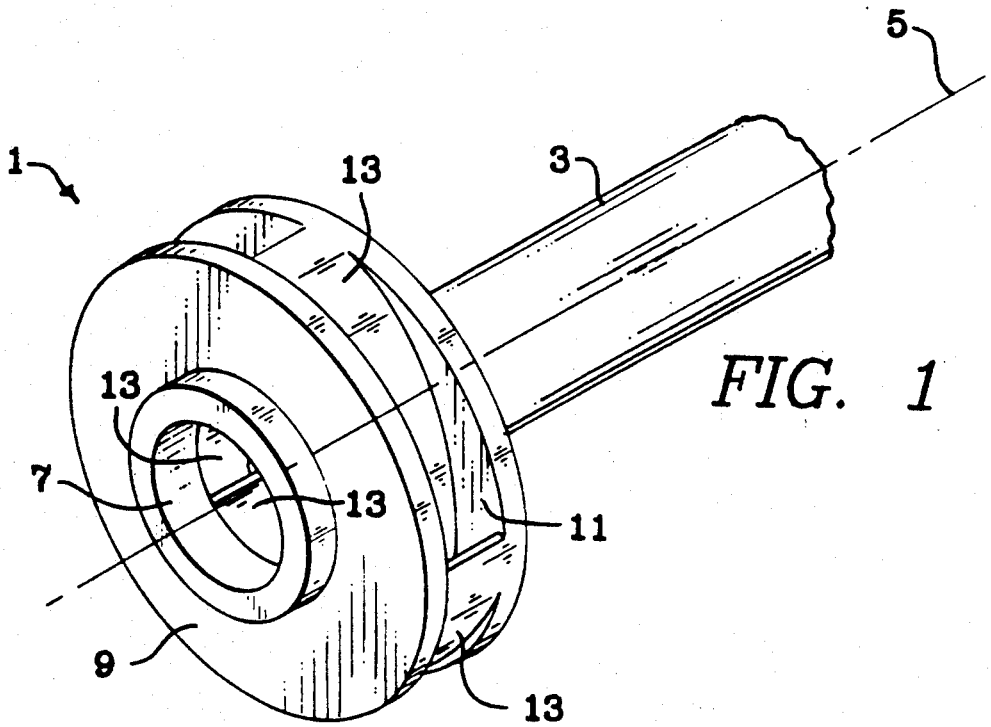
FIG. 1 is an isometric view of an embodiment of the impeller of this invention.

FIG. 1 shows an isometric view of a straight-vane, single suction, closed impeller, embodying the invention described herein. Impeller 1 is mounted on a shaft 3, rotatable about center-line 5. Impeller 1 forms a suction eye 7 through which liquid enters the impeller 1. Impeller 1 is formed by a front shroud member 9 and a rear hub member 11 spaced therefrom. Shroud member 9 and hub-member 11 have inner surfaces (not shown) substantially parallel to each other and extending in a plane transverse of, and perpendicular to, centerline 5 of shaft 3, as is conventional. A plurality of vanes 13 extend between shroud member 9 and hub member 11.

Figure 2:
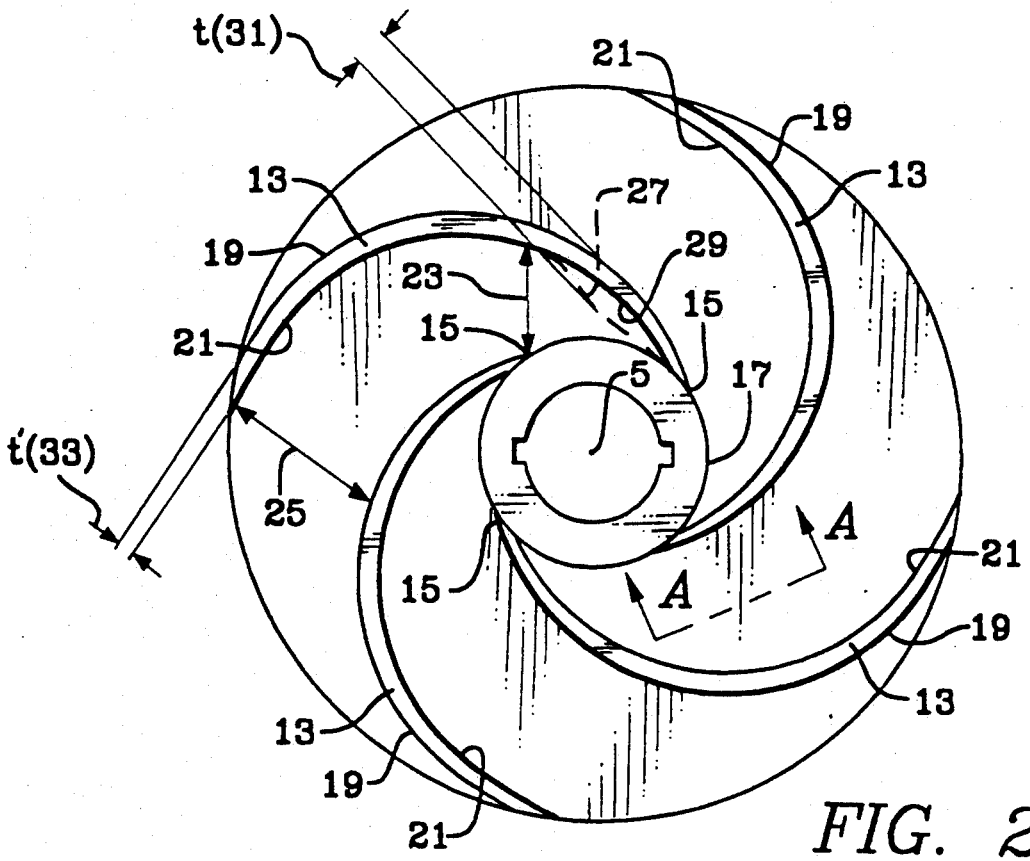
FIG. 2 is a top view, with the shroud removed, of a straight-vaned impeller, showing a vane according to the prior art and, in dotted line, a vane according to an embodiment of this invention.

Referring now to FIG. 2, vanes 13 are arranged in an annulus, with leading inlet edges 15 disposed at the periphery 17 of a circle with a diameter at the centerline 5 of shaft 3, as is conventional. Each vane 13 is identical and a description cf one will suffice for all.

Each vane 13 has a pressure side 19 and a suction side 21. Each pair of adjacent vanes 13 forms and inlet throat 23 and an outlet opening 25, as is well known. Inlet throat 23 is defined herein as the shortest distance between a pressure side 19 of a vane 13 and an adjacent suction side 21 of an adjacent vane 13, when viewed in a top view. As used herein, the top view is shown on a plane transverse of, and perpendicular to centerline 5 of shaft 3, as in FIG. 2. Dotted line 27 represents the suction surface of a vane of this invention, and solid line 29 represents the suction surface of a prior art vane.

When viewed in a top view, the thickness t (31) of each vane 13 upstream of throat 23 is greater than the thickness t'(33) of that same vane 13 down stream of throat 23. The greater thickness t (31) helps to reduce cavitation at various flow rates, especially at flow rates lower than optimum. The greater thickness t (31) of van 13 can be achieved by adding material to the vane at the suction side 21, along the length of vane 13 between the throat 23 and inlet edge 15 upstream thereof. The thickness t'(33) of vane 13 downstream of the throat 23 is retained in the range already utilized in the prior art. The inlet throat 23 dimension is, therefore, unchanged over prior art throats which are used, thereby, avoiding cavitation head loss.

Figure 3:
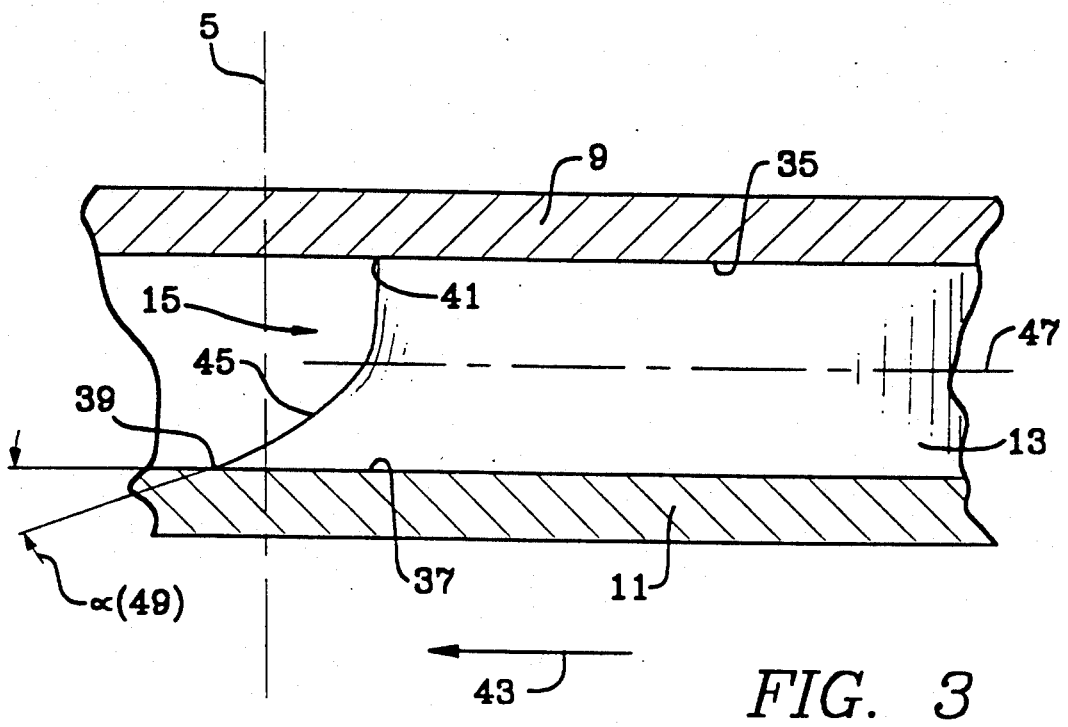
FIG. 3 is a side view, in a plane tangent to the pressure side of an impeller vane, along the lines of A—A of FIG. 2.

Referring now to FIG. 3, a side view of a single vane 13 of this invention, with parts removed, is shown. As used herein, the side view is on a plane parallel to the length of center-line 5, and perpendicular to the plane used for a top view.

Each vane 13 has a span that extends between, and connects to, the inner surface 35 of shroud member 9 and inner surface 37 of hub member 11.

Inlet edge 15 of vane 13 has a root portion 39 intersecting hub surface 37 and a tip portion 41 intersecting shroud surface 35. Root portion 39 is located upstream of tip portion 41 as indicated by the direction of rotation represented by arrow 43. When viewed in a side view, tip portion 41 intersects shroud surface 35 at a substantially perpendicular intersection, as is conventional, but inlet edge 15 begins to form a concave surface 45 as it extends toward upstream root portion 39. The concave surface 45 begins to form at a point along inlet edge 15 which is located between tip portion 41 and the mid-point of the span of vane 13, represented by dotted line 47. It should be understood that the beginning of concave surface 45 can start at any point along inlet edge 15 between the aforesaid tip 41 and mid-point 47. Concave surface 45 extends upstream to root portion 39, as described hereinabove.

For best results, we prefer that the limit of concave surface 45 be defined by angle $\alpha$ (49) formed between inner surface 37 of hub 11 and a line drawn tangent to concave surface 45 at the intersection of concave surface 45 and inner surface 37. Angle $\alpha$ (49) must be less than 45 degrees, for optimal results. This upstream root configuration provides the benefit of increased resistance to cavitation, when used in combination with the vane thickness relationship described hereinabove.

Figure 4:
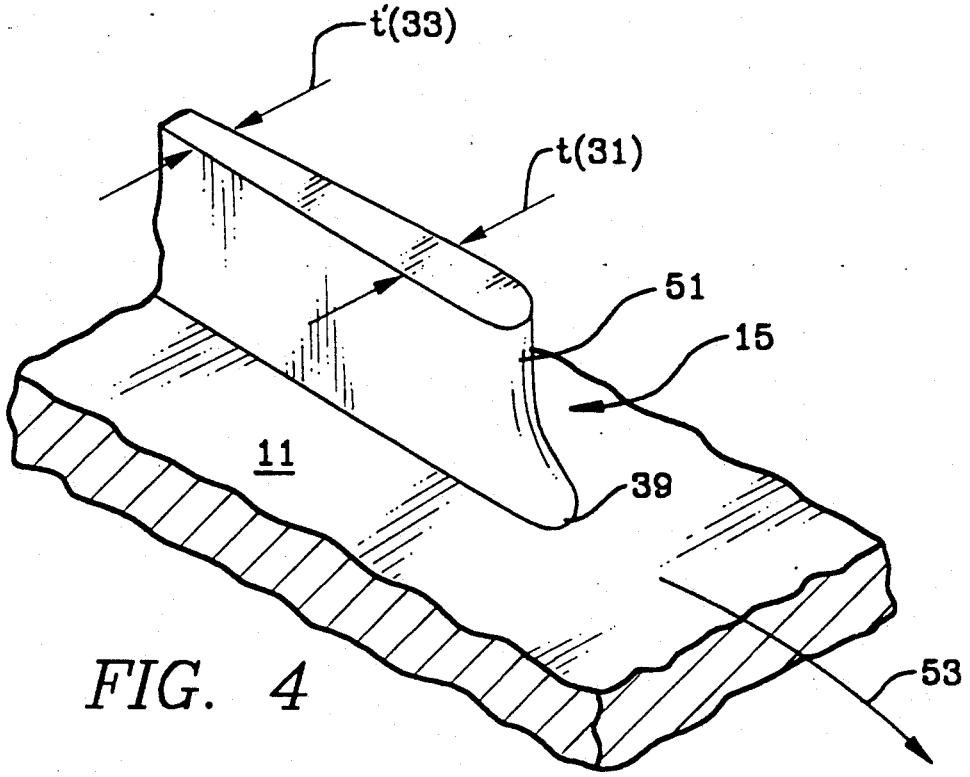
FIG. 4 is an isometric view, with the shroud member and part of the hub removed, of the leading edge of a vane of an embodiment of this invention showing the thickness of the vane between the leading edge and the throat area, and the elliptical nose of a vane.
Figure 5:
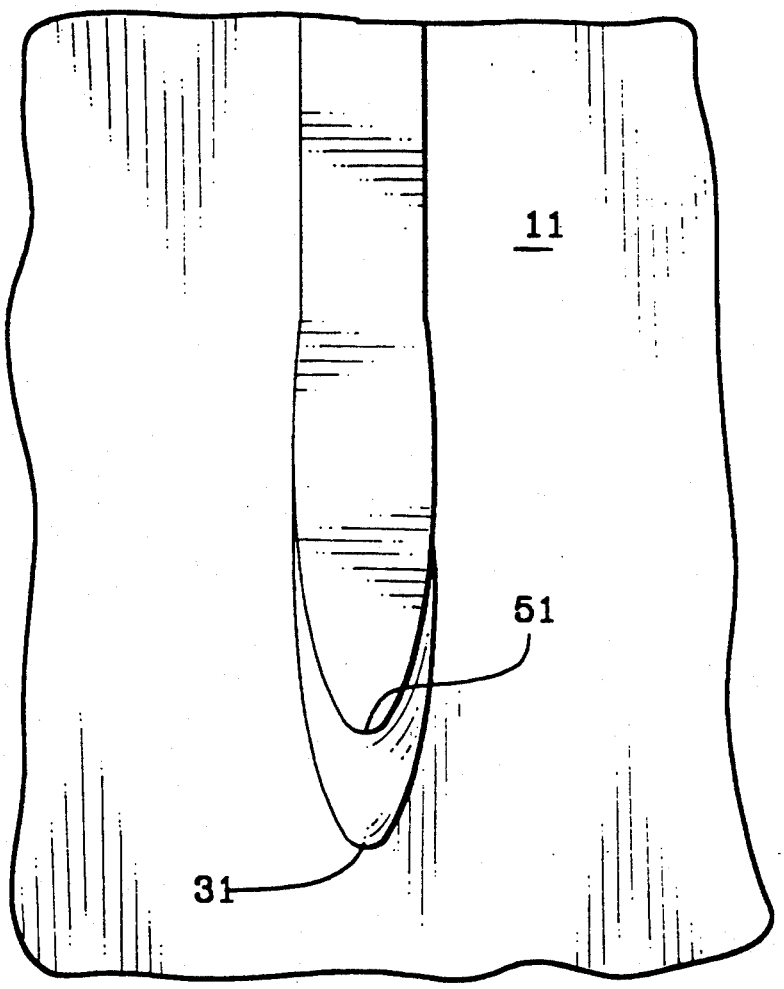
FIG. 5 is a top view of the nose portion of the vane shown in FIG. 4.

Referring to FIG. 4, the inlet edge 15 is shown having a nose 51, that forms an elliptical surface when viewed in top view. The direction of rotation is shown by arrow 53. The combination of elliptical nose 51, upstream root portion 39 and differential vane thicknesses t (31) and t' (33) all combine to provide superior resistance to cavitation formation.

While we have described our invention in a straight-vaned, or radial, impeller it would be equivalent to provide it in a Francis-type, or semi-axial impeller, with the same beneficial results. Likewise, it would be equivalent to provide it in an impeller known in the art as a semi-open impeller.

Having described the invention, what is claimed is:

1. In an impeller for liquid-conveying centrifugal pumps having a front shroud member, a rear hub member, a plurality of vanes therebetween having leading inlet edges disposed at the periphery of a circle, and an inlet throat opening between a suction side of one vane and a pressure side of an adjacent vane, means for inhibiting cavitation comprising:

(a) each vane including:

(i) a span between said shroud member and said hub member;

(ii) a leading inlet edge having a root portion extending upstream of a tip portion;

(iii) said leading inlet edge forming a concave surface beginning at a location between said tip portion and the mid-point of said span, said concave surface extending upstream to said root portion; and (iv) a vane thickness upstream of said inlet throat opening greater than a vane thickness downstream of said throat opening.

2. The invention of claim 1 in which a line tangent to said concave surface intersects the surface of said hub member, at an angle not greater than 45 degrees.

3. The invention of claim 2 in which said leading inlet edge has an elliptical nose.

4. An impeller for liquid-conveying centrifugal pumps comprising:

(a) a front shroud member;

(b) a rear hub member spaced from said shroud member;

(c) a plurality of vanes therebetween having leading inlet edges disposed at the periphery of a circle, each pair of vanes forming an inlet throat opening between a suction side of one vane and a pressure side of an adjacent vane;

(d) each vane including:

(i) a span between said shroud member and said hub member;

(ii) a leading inlet edge having a root portion extending upstream of a tip portion;

(iii) said leading inlet edge forming a concave surface beginning at a location between said tip portion and the mid-point of said span, said concave surface extending upstream to said root portion;

(iv) a vane thickness upstream of said throat opening greater than a vane thickness downstream of said throat opening; and (v) an elliptical nose on said leading inlet edge.

5. An impeller for liquid-conveying centrifugal pumps comprising:

(a) a front shroud member;

(b) a rear hub member spaced from said shroud member;

(c) a plurality of vanes therebetween having leading inlet edges disposed at the periphery of a circle, each pair of vanes forming an inlet throat opening between a suction side of one vane and a pressure side of an adjacent vane;

(d) each vane including:

(i) a span between said shroud member and said hub member;

(ii) a leading inlet edge having a root portion extending upstream of a tip portion;

(iii) said leading inlet edge forming a concave surface beginning at a location between said tip portion and the mid-point of said span, said concave surface extending upstream to said root portion; and (iv) an elliptical nose on said leading inlet edge.

* * * * *